US009697662B2

(12) United States Patent
Wang

(10) Patent No.: US 9,697,662 B2
(45) Date of Patent: Jul. 4, 2017

(54) LOCK CONTROL METHOD REQUIRING ACTIVATION BY A FIRST CHANNEL AND AUTHORIZATION BY A SECOND DIFFERENT CHANNEL

(71) Applicant: LEADOT INNOVATION, INC., Kaohsiung (TW)

(72) Inventor: Justin Wang, Taipei (TW)

(73) Assignee: LEADOT INNOVATION, INC., Kaohsiung (TW)

( * ) Notice: Subject to any disclaimer, the term of this patent is extended or adjusted under 35 U.S.C. 154(b) by 0 days.

(21) Appl. No.: 14/708,279

(22) Filed: May 10, 2015

(65) Prior Publication Data

US 2015/0371467 A1 Dec. 24, 2015

(30) Foreign Application Priority Data

Jun. 24, 2014 (TW) ..... 103121758 A

(51) Int. Cl.
*G07C 9/00* (2006.01)

(52) U.S. Cl.
CPC . *G07C 9/00309* (2013.01); *G07C 2009/0042* (2013.01); *G07C 2009/00365* (2013.01); *G07C 2209/61* (2013.01)

(58) Field of Classification Search
CPC ..... G07C 9/00309; G07C 2009/0042; G07C 2009/00365; G07C 2209/61; G07C 2209/64; G07C 9/00015; G07C 9/00111; G07C 2009/00793; G07C 2209/644; B60R 25/24; B60R 25/245
USPC ..... 340/5.26, 5.6, 5.65, 426.36
See application file for complete search history.

(56) References Cited

U.S. PATENT DOCUMENTS 5,926,106 A * 7/1999 Beran ..... G07C 9/00111 327/261
6,225,889 B1 5/2001 Furuta
6,801,134 B1 * 10/2004 Juzswik ..... B60R 25/2072 307/10.2
7,050,587 B1 * 5/2006 Berberich ..... B60R 25/24 380/262
2005/0204167 A1 * 9/2005 Conlin ..... G07C 9/00007 726/5
2007/0287418 A1 * 12/2007 Reddy ..... H04W 12/00 455/410
2009/0096576 A1 * 4/2009 Oman ..... G07C 5/008 340/5.62

(Continued)

FOREIGN PATENT DOCUMENTS

CN 202422247 U 9/2012
CN 202694430 U 1/2013

(Continued)

*Primary Examiner* — Quan-Zhen Wang
*Assistant Examiner* — Stephen Burgdorf
(74) *Attorney, Agent, or Firm* — Winston Hu

(57) ABSTRACT

An activate signal is sent out from a remote controller via a first channel. An authorization process is activated after the activate signal is received by an access control terminal. A control signal is sent out from the remote controller via a second channel to the access control terminal. The access control terminal is unlocked if the control signal received by the access control terminal is verified by the authorization process to be consistent with a predetermined rule. The first channel is different from the second channel.

5 Claims, 9 Drawing Sheets

(56) References Cited

U.S. PATENT DOCUMENTS

| | | | | |
|---|---|---|---|---|
| 2009/0210101 | A1* | 8/2009 | Hawkins | A63F 9/04 700/297 |
| 2013/0237189 | A1* | 9/2013 | Nishidai | H04W 12/06 455/411 |
| 2014/0176301 | A1* | 6/2014 | Fernandez Banares | G07C 9/00015 340/5.26 |

FOREIGN PATENT DOCUMENTS

| | | | |
|---|---|---|---|
| EP | 0 502 566 | A1 | 9/1992 |
| JP | S6171797 | A | 4/1986 |
| JP | H05287947 | A | 11/1993 |
| JP | H07226979 | A | 8/1995 |
| JP | 2002235470 | A | 8/2002 |
| JP | 2002295892 | A | 10/2002 |
| JP | 201041411 | A | 2/2010 |
| TW | 200300028 | | 5/2003 |
| TW | I322847 | | 4/2010 |
| TW | M416945 | | 11/2011 |
| TW | M429746 | | 5/2012 |
| TW | M448543 | | 3/2013 |
| WO | 2007128319 | A2 | 11/2007 |

* cited by examiner

LOCK CONTROL METHOD REQUIRING ACTIVATION BY A FIRST CHANNEL AND AUTHORIZATION BY A SECOND DIFFERENT CHANNEL

BACKGROUND OF THE INVENTION

1. Field of the Invention

The present application relates to a lock control method, and more particularly, a lock control method using multiple channels for controlling a lock.

2. Description of the Prior Art

According to the prior art, a user operates a remote controller to lock or unlock an anti-theft lock such as a garage lock. When unlocking a lock, a user sends an unlock control signal from a remote controller to the lock to perform an unlock operation such as opening a rolling door. The garage lock of the prior art is always power supplied by a socket and allows the door to be opened when being unlocked. According to the method of the prior art, the said lock/unlock control signal is sent with a single channel.

The lock described above is insecure. When operating a remote controller to send a control signal to lock or unlock, a thief can steal the adopted frequency by a frequency scanning method, and then use the stolen frequency to send a signal for unlocking the door. Hence, the lock of the prior art is easily cracked, and crimes of this sort are quite common. It is necessary to develop a lock control method to improve the anti-theft capability of the locks.

SUMMARY OF THE INVENTION

An embodiment of the present invention discloses a lock control method. The lock control method includes a remote controller sending an activate signal via a first channel by using a telecommunication technology; an access control terminal activating an authorization process when receiving the activate signal via the first channel; the remote controller sending a set of control signals sequentially to the access control terminal via a set of second channels by using the telecommunication technology; the access control terminal receiving the set of control signals via the set of second channels; and the access control terminal unlocking a switch and/or a lock when the set of control signals is verified by the authorization process to be consistent with a predetermined rule; wherein the first channel is different from the set of second channels.

Another embodiment of the present application discloses a lock control method. The lock control method includes a remote controller selecting a first channel by a first channel selector according to time so as to send an activate signal via the first channel by using a telecommunication technology; an access control terminal selecting the first channel by a second channel selector according to time so as to receive the activate signal via the first channel; the access control terminal activating an authorization process when receiving the activate signal via the first channel; the remote controller selecting a set of second channels by the first channel selector according to time so as to send a set of control signals sequentially to the access control terminal via the set of second channel; the access control terminal selecting the set of second channels by the second channel selector according to time so as to receive the set of control signals sequentially via the set of second channels; and the access control terminal unlocking a switch and/or a lock when the set of control signals is verified by the authorization process to be consistent with a predetermined rule.

An additional embodiment of the present application discloses a lock control method. The lock control method includes a remote controller sending an activate signal via a first channel by using a telecommunication technology; an access control terminal activating an authorization process when receiving the activate signal via the first channel; the access control terminal sending a rolling code key to the remote controller via a second channel; the remote controller inputting the rolling code key in a rolling code generator so as to generate a rolling code by the rolling code generator; the remote controller sending a control signal including the rolling code to the access control terminal via a third channel by using the telecommunication technology; the access control terminal receiving the control signal via the third channel by using the telecommunication technology; and the access control terminal unlocking a switch and/or a lock when the control signal and the rolling code are verified by the authorization process to be consistent with a predetermined rule.

An additional embodiment of the present application discloses a lock control method. The lock control method includes a remote control module sending an activate signal via a first channel by using a telecommunication technology; an access control terminal activating an authorization process when receiving the activate signal via the first channel; the access control terminal sending a rolling code key to a remote controller of the remote control module via a second channel by using the telecommunication technology; the remote controller inputting the rolling code key in a rolling code generator of the remote control module so as to generate a rolling code by the rolling code generator; a signal transmitter of the remote control module sending a control signal including the rolling code to the access control terminal via a third channel by using the telecommunication technology; the access control terminal receiving the control signal via the third channel by using the telecommunication technology; and the access control terminal unlocking a switch and/or a lock when the control signal and the rolling code are verified by the authorization process to be consistent with a predetermined rule.

These and other objectives of the present invention will no doubt become obvious to those of ordinary skill in the art after reading the following detailed description of the preferred embodiment that is illustrated in the various figures and drawings.

DETAILED DESCRIPTION

A First Embodiment

Figure 1:
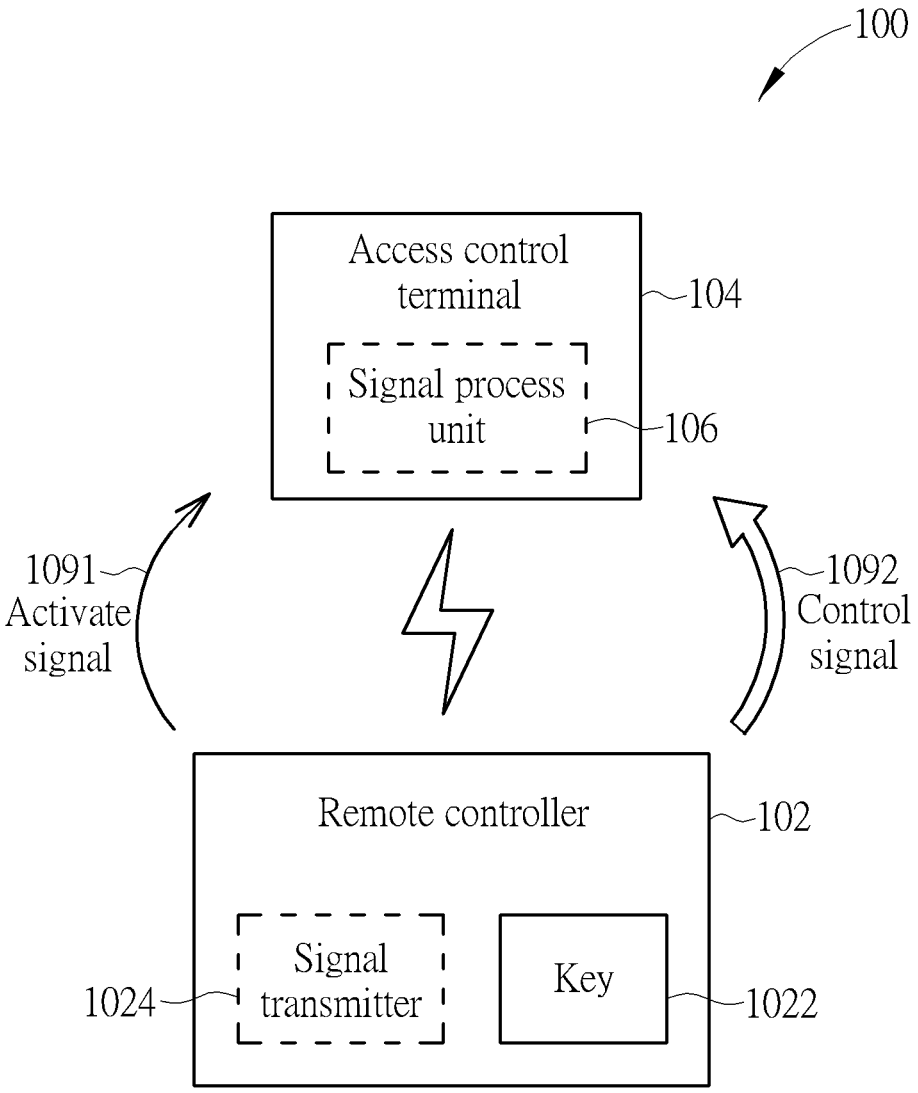
FIG. 1 illustrates a lock system according to a first embodiment of the present application.

FIG. 1 illustrates a lock system 100 according to a first embodiment of the present application. The lock system 100 may include a remote controller 102 and an access control terminal (e.g. a door terminal). The remote controller 102 may include a key 1022 for controlling the remote controller 102. When a user triggers the key 1022, the remote controller 102 may send out a signal including an activate signal 1091 and a control signal 1092. The key 1022 may be any kind of key such as a graphic user interface (GUI) on a touch screen or a mechanical button. The remote controller 102 may include a signal transmitter 1024 for generating and transmitting signals. The access control terminal 104 may include a signal process unit 106 for performing an authorization process used to process and authorize the signals transmitted from the remote controller 102. The signal transmitter 1024 may transmit signals via a single channel or a plurality of channels. The access control terminal 104 may be an anti-theft lock terminal installed at home, office, car or other applications. When the access control terminal 104 is unlocked, a door or an anti-theft equipment of a house or a car is correspondingly unlocked. The communication between the remote controller 102 and the access control terminal 104 may be built by using infra-red technology, radio frequency technology, near field communication (NFC) technology, Wi-Fi technology, Zigbee technology, UHF radio technology, internet network technology, email technology, browser interactive interface technology, instant messaging (IM) technology and/or a mobile phone texting technology.

Figure 2:
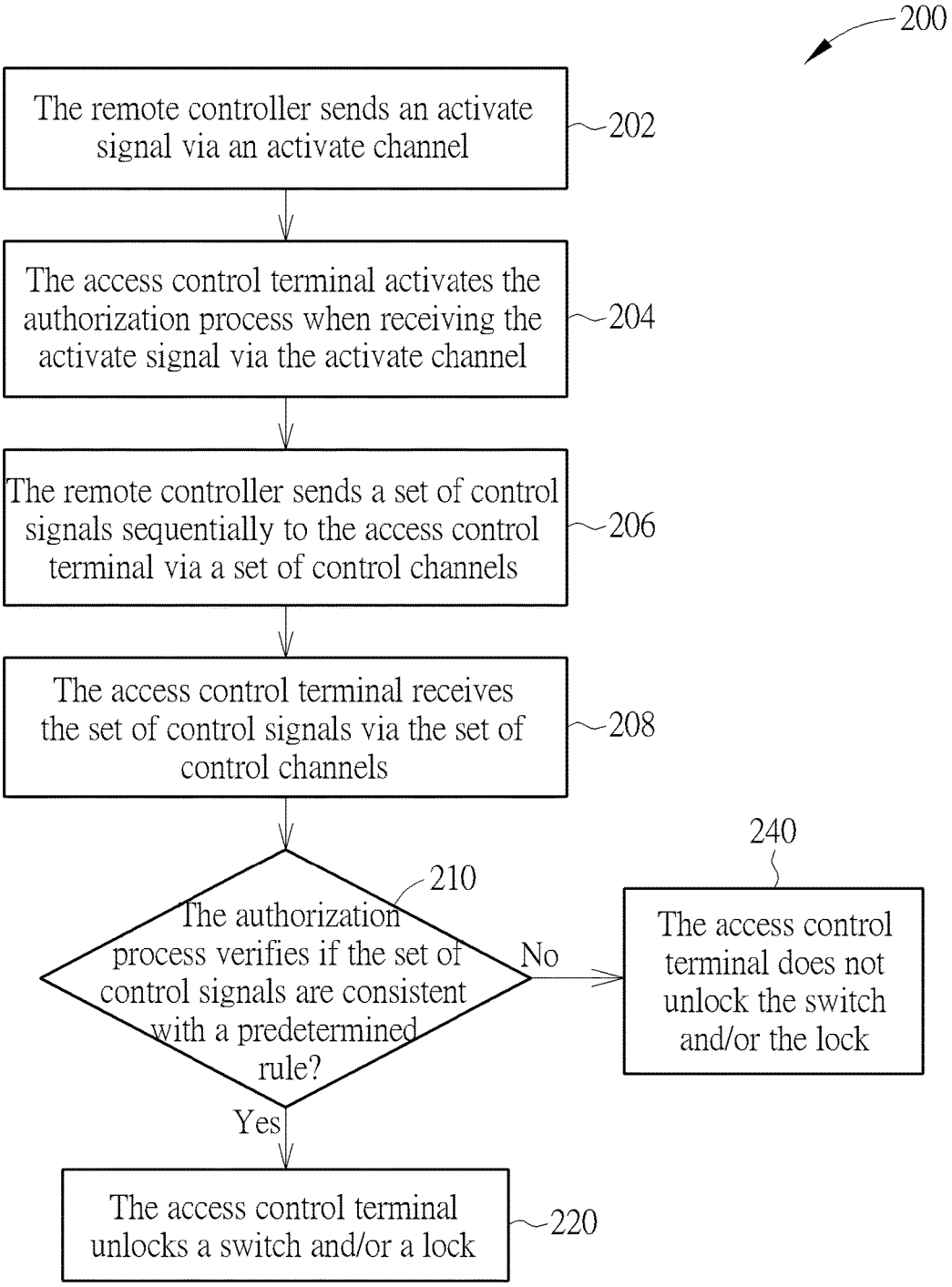
FIG. 2 illustrates a flowchart of a lock control method for controlling the lock system shown in FIG. 1.

FIG. 2 illustrates a flowchart of a lock control method 200 for controlling the lock system 100 shown in FIG. 1. The lock control method 200 may include the following steps:

Step 202: the remote controller 102 sends an activate signal 1091 via an activate channel (i.e. a first channel);

Step 204: the access control terminal 104 activates the authorization process when receiving the activate signal 1091 via the activate channel;

Step 206: the remote controller 102 sends a set of control signals 1092 sequentially to the access control terminal 104 via a set of control channels (i.e. second channels);

Step 208: the access control terminal 104 receives the set of control signals 1092 via the set of control channels;

Step 210: the authorization process verifies if the set of control signals 1092 are consistent with a predetermined rule? If yes, go to step 220; if no, go to step 240;

Step 220: the access control terminal 104 unlocks a switch and/or a lock; end; and Step 240: the access control terminal 104 does not unlock the switch and/or the lock.

According to the lock control method 200, the set of control channels is different from the activate channel. For example, the activate channel may be a channel of 433 megahertz (MHz) frequency while the control channel may be a channel of 868 MHz frequency. Hence, even if a thief hides behind a user's house and uses a frequency scan equipment to recognize that two channels of 433 Mhz and 868 Mhz are adopted around this area, the thief cannot know that the two channels are used in a same lock system because a lock system of the prior art only uses one channel of single frequency. Besides, the set of control channels may further be of one or more frequencies. When the set of control channels are of multiple frequencies, the adopted frequencies may be different from one another. For another example, if the set of control channels includes three control channels for sending a control signal A, a control signal B and a control signal C separately, the frequencies of the three control channels may be 433 MHz, 868 Mhz and 916 MHz separately, and the said activate channel may be with 315 MHz frequency (for sending the activate signal 1091 shown in FIG. 1). The channels and signals are shown in the following table.

| sort of channel | frequency | usage |
|---|---|---|
| activate channel | 315 MHz | sending active signal |
| control channel | 433 MHz | sending control signal A |
| | 868 MHz | sending control signal B |
| | 916 MHz | sending control signal C |

Referring to FIGS. 1 and 2, in step 202 the remote controller 102 sends the activate signal 1091 to the access control terminal 104 via the activate channel with 315 MHz frequency so that the access control terminal 104 activates an authorization process. In step 206, the control signals A, B and C are sent to the access control terminal 104 via the control channels with 433 MHz, 868 MHz and 916 MHz frequencies separately. In step 210, the signal process unit 106 may verify if the control signals A, B and C are consistent with a predetermined rule such as a predetermined rule set in a lookup table of the authorization process. If the control signals A, B and C are verified to be correct, a switch and/or a door of the access control terminal 104 (e.g. a garage door) is unlocked.

According to the embodiment described above, the access control terminal 104 may be unlocked only when the control signals A, B and C are correct, and (the frequencies of) the channels for the control signals A, B and C are correct. In this way, even if a thief uses a frequency scanner to get several channels and the corresponding frequencies, it is still difficult to know the correct sequence and the sent control signals of those channels. Hence, the lock control method 200 may lead to an anti-theft effect by using multiple channels with different frequencies.

A Second Embodiment

Figure 3:
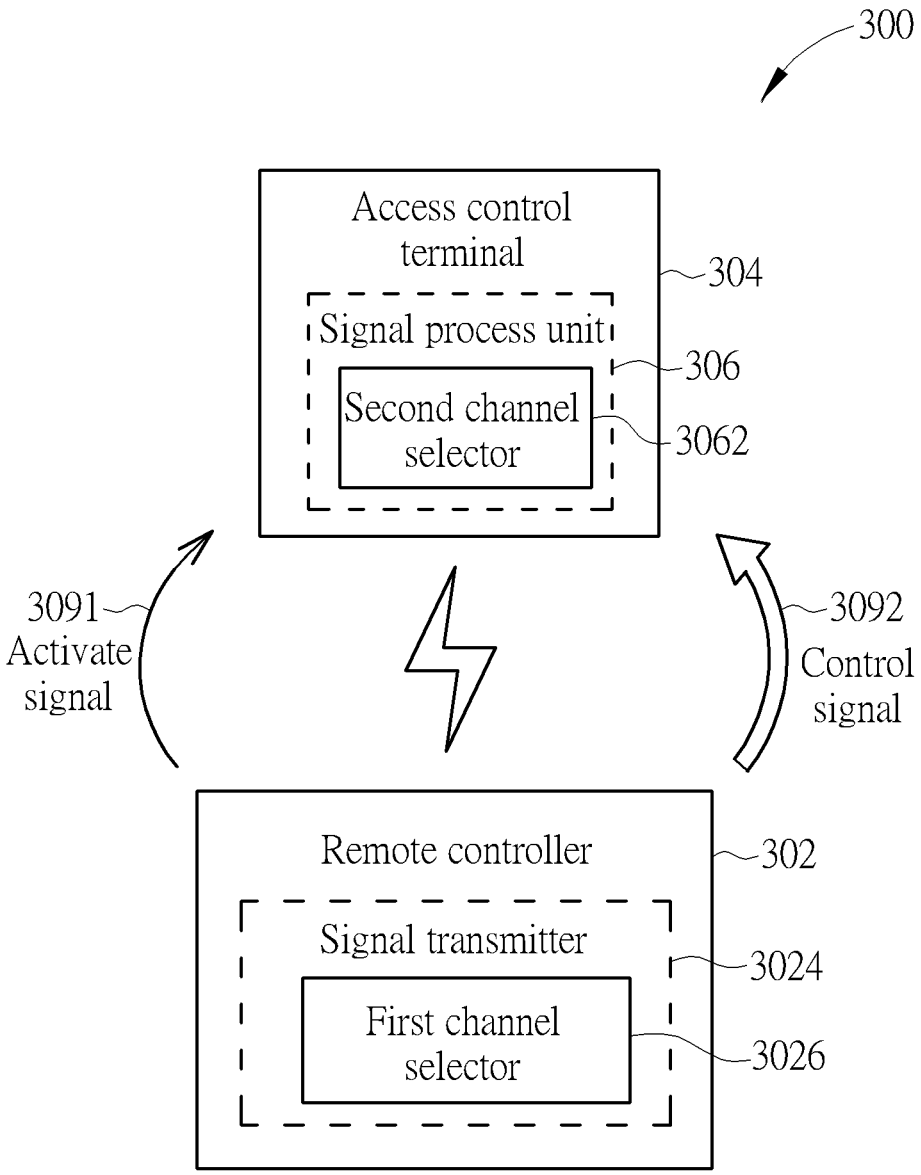
FIG. 3 illustrates a lock system according to a second embodiment of the present application.

FIG. 3 illustrates a lock system 300 according to a second embodiment of the present application. The lock system 300 includes a remote controller 302 having a signal transmitter 3024, and an access control terminal 304 (e.g. a door terminal) having a signal process unit 306. The signal transmitter 3024 includes a first channel selector 3026, and the signal process unit 306 includes a second channel selector 3062.

Figure 4:
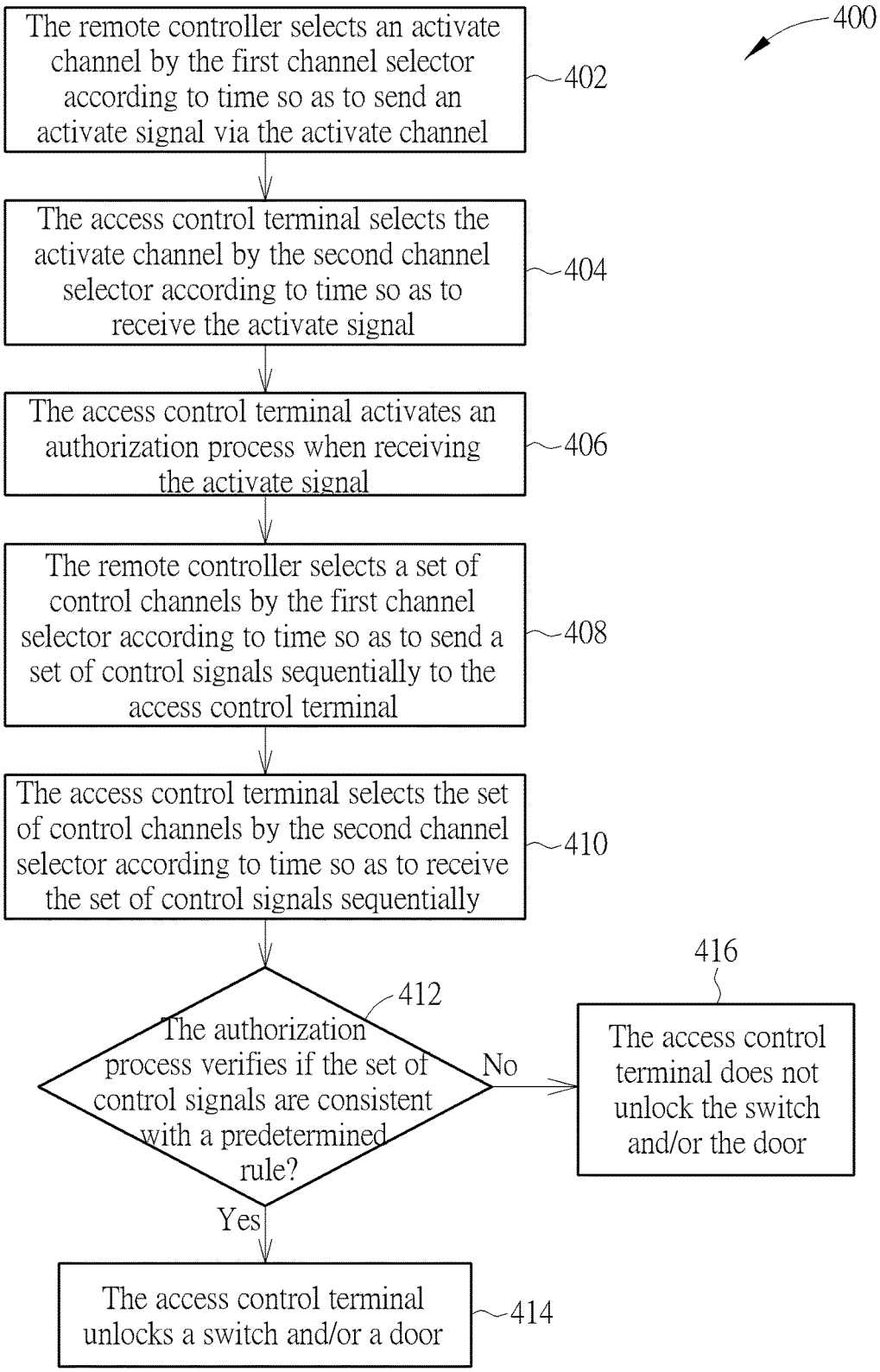
FIG. 4 illustrates a flow chart of a lock control method for controlling the lock system shown in FIG. 3.

FIG. 4 illustrates a flow chart of a lock control method 400 for controlling the lock system 300 shown in FIG. 3. The lock control method 400 may include the following steps.

Step 402: the remote controller 302 selects an activate channel (i.e. a first channel) by the first channel selector 3026 according to time so as to send an activate signal 3091 via the activate channel by using a telecommunication technology;

Step 404: the access control terminal 304 selects the activate channel by the second channel selector 3062 according to time so as to receive the activate signal 3091 via the activate channel;

Step 406: the access control terminal 304 activates an authorization process when receiving the activate signal 3091 via the activate channel;

Step 408: the remote controller 302 selects a set of control channels (i.e. a set of second channels) by the first channel selector 3026 according to time so as to send a set of control signals 3092 sequentially to the access control terminal 304 via the set of control channels;

Step 410: the access control terminal 304 selects the set of control channels by the second channel selector 3062 according to time so as to receive the set of control signals 3092 sequentially via the set of control channels;

Step 412: The authorization process verifies if the set of control signals 3092 are consistent with a predetermined rule? If yes, go to step 414; if no, go to step 416;

Step 414: A switch and/or a door of the access control terminal 304 is unlocked; end; and Step 416: The switch and/or the door of the access control terminal 304 keeps being locked.

Comparing the lock control method 400 with the said lock control method 300, according to the lock control method 400, the activate channel also differs from the set of the control channels in frequency as the lock control method 300, that is to say, multiple frequencies are also adopted. According to the method 400, the frequency of the activate channel is further selected according to time by the first channel selector 3026 for sending the activate signal 3091 in step 402, and the frequency of the activate channel is selected according to time by the second channel selector 3062 for receiving the activate signal 3091 in step 404. Hence, even if a thief uses a frequency scanner to crack and know the adopted channels, because the adopted channels vary according to time, the cracked channels determined by the thief become invalid after a predetermined period. Similarly, the first channel selector 3026 of the remote controller 302 selects a set of control channels according to time for sending the set of control signals 3092 in step 408, and the second channel selector 3062 of the access control terminal 304 selects the same set of control channels for receiving the set of control signals 3092 in step 410. The used activate channel and the control channel(s) may vary depending on the time at which a user operates the lock system. For example, when a user leaves for office at 7:55 A.M. and comes back home at 8:20 P.M., the activate channel and the control channel(s) selected in the morning may differs from what is selected in the evening in frequency and channel combinations. Hence, the lock system and lock control method may have a good anti-theft effect. The channels and corresponding frequencies may be shown as the following table.

| operation time | 7:55 A.M. | |
|---|---|---|
| sort of channel | frequency | usage |
| activate channel | 315 MHz | sending active signal |
| control channel | 433 MHz | sending control signal A |
| | 868 MHz | sending control signal B |
| | 916 MHz | sending control signal C |

-continued

| operation time | 8:20 P.M. | |
|---|---|---|
| sort of channel | frequency | usage |
| activate channel | 433 MHz | sending active signal |
| control channel | 868 MHz | sending control signal A |
| | 916 MHz | sending control signal B |
| | 315 MHz | sending control signal C |

Hence, the frequencies of the selected activate channel and control channel(s) may vary by time so that the anti-theft effect is improved.

In order for the channels selected by the first channel selector 3026 (of the remote controller 302) to match the channels selected by the second channel selector 3062 (of the access control terminal 304) so as to transmit and receive signals correctly, the first channel selector 3026 and the second channel selector 3062 need to synchronize to one another for the clocks of the two selectors to be synchronous. The remote controller 302 and the access control terminal 304 may sense one another to synchronize via a near-field-communication (NFC) or Bluetooth way. The remote controller 302 and the access control terminal 304 may be embedded radio clocks/watches to be automatically synchronized by time-code signals transmitted by a radio station connected to a time standard such as anatomic clock so that the first and second channel selectors 3026 and 3062 may be synchronized with one another. According to an embodiment of the present application, the tolerance between times measured by the remote controller 302 and the access control terminal 304 may be a predetermined value (e.g. plus-minus 3 seconds) for the channels selected by the first and second channel selectors to match one another without false error so as to transmit/receive the active/control signals correctly.

According to another embodiment of the present application, the channels selected by the first and the second channel selectors may be not limited to radio channels with operating frequencies. The selected channels may be of multiple communication technologies. For example, the selected activate channel may be a UHF radio channel at a first time period and an internet channel accessed by instant massages (IM) at a second time period so as to adopt multiple channels for better security. Furthermore, according to another embodiment of the present application, if using different accounts to send/receive instant massages for transmitting/receiving signals via an internet between the remote controller and the access control terminal (e.g. a garage door terminal), this may be regarded as using different channels (i.e. multiple channels) to transmit/receive signals.

A Third Embodiment

Figure 5:
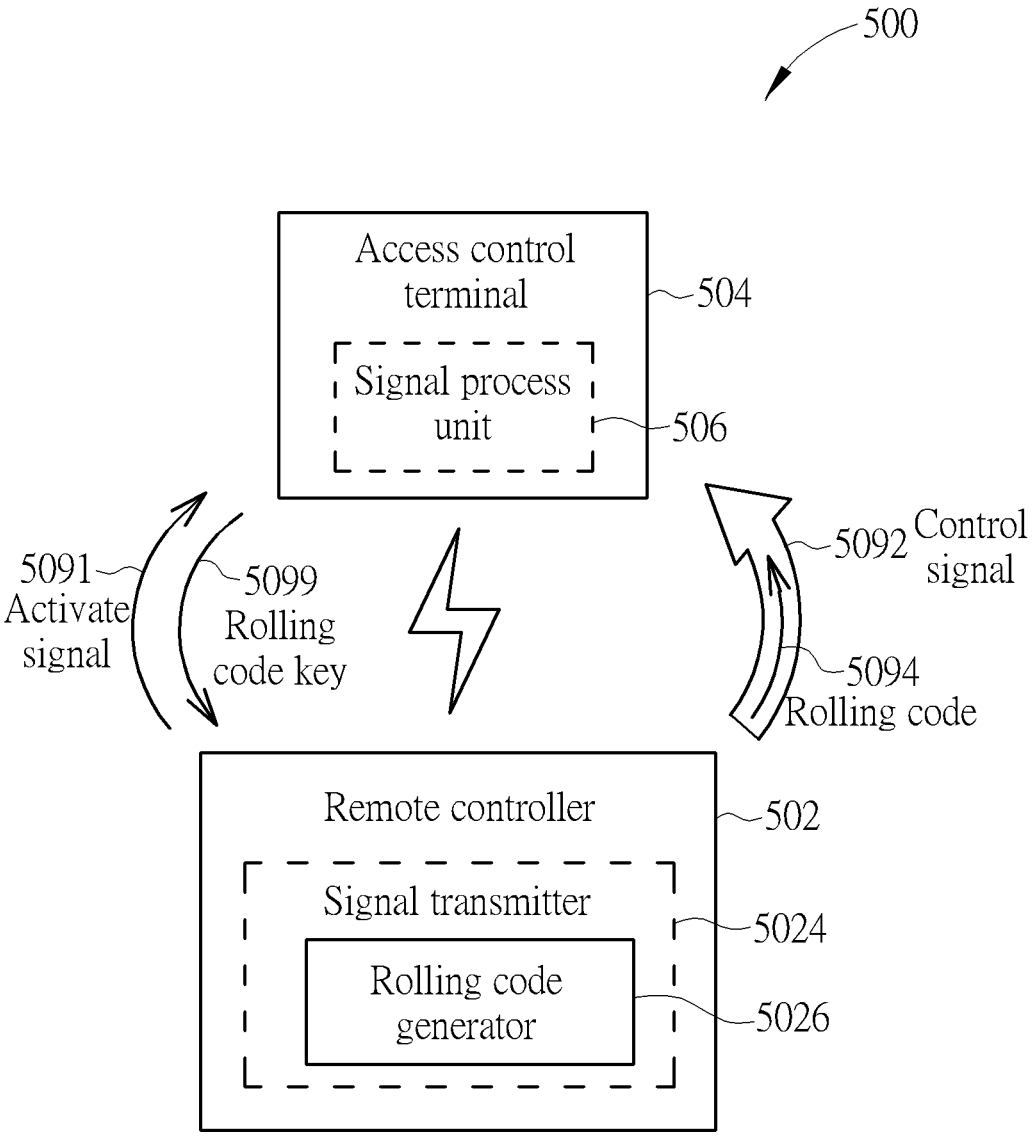
FIG. 5 illustrates a lock system according to a third embodiment of the present application.

FIG. 5 illustrates a lock system 500 according to a third embodiment of the present application. The lock system 500 includes a remote controller 502 having a signal transmitter 5024 including a rolling code generator 5026, and an access control terminal 504 having a signal process unit 506. The remote controller 502 is configured to send an activate signal 5091, send a control signal 5092 and receive a rolling code key 5099. The access control terminal 504 is configured to receive the activate signal 5091, receive the control signal 5092 and send the rolling code key 5099. The rolling code generator 5026 is configured to generate a rolling code 5094 according to the received rolling code key 5099. The signal process unit 506 is configured to process the activate signal 5091 and the control signal 5092 received from the remote controller 502, and generate the rolling code key 5099. As shown in FIG. 5, the rolling code 5094 is carried by the control signal 5092.

Figure 6:
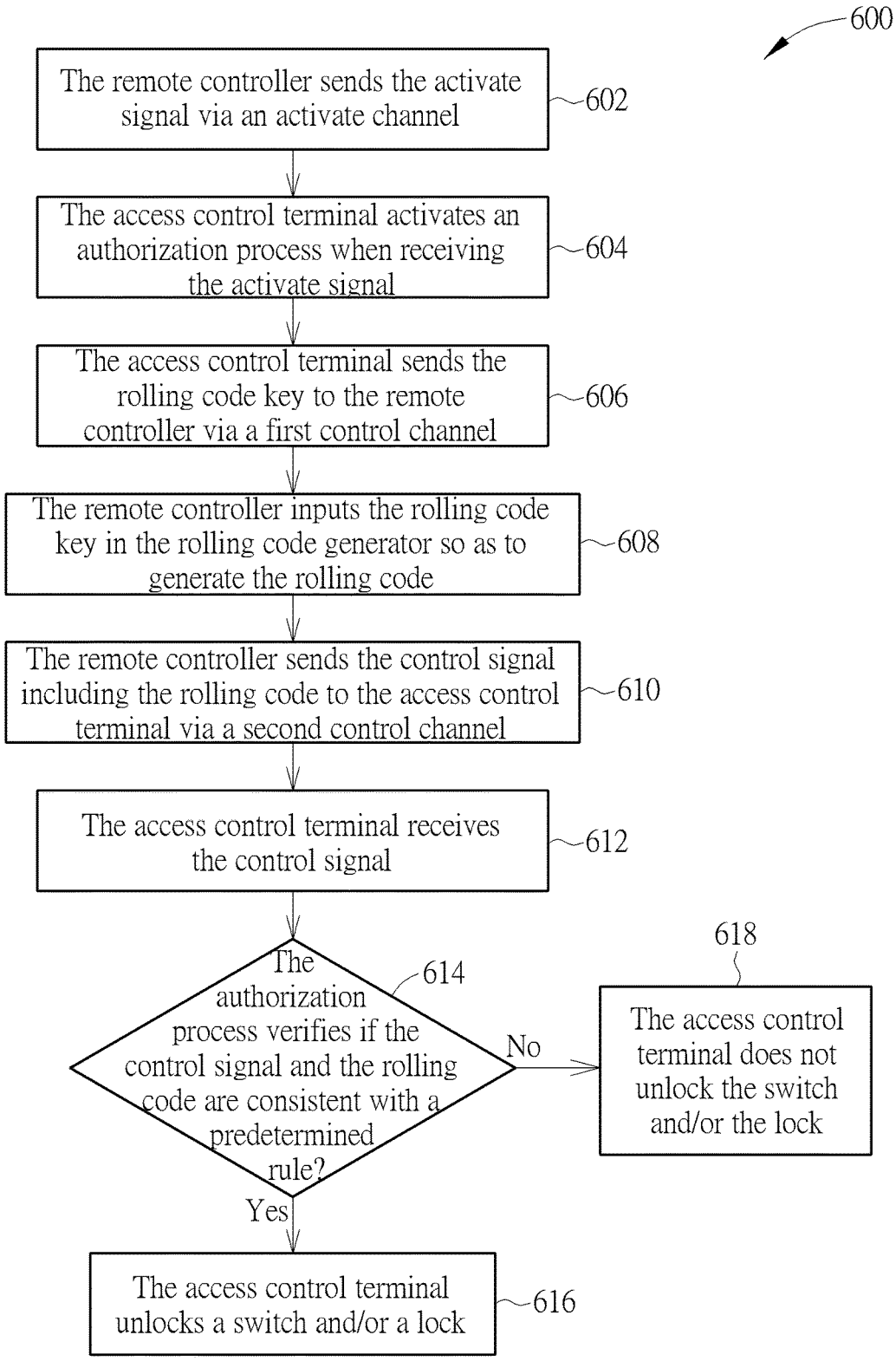
FIG. 6 illustrates a flow chart of a lock control method for controlling the lock system shown in FIG. 5.

FIG. 6 illustrates a flow chart of a lock control method 600 for controlling the lock system 500 in FIG. 5. The lock control method 600 includes the following steps.

Step 602: the remote controller 502 sends the activate signal 5091 via an activate channel (first channel) by using a telecommunication technology;

Step 604: the access control terminal 504 activates an authorization process when receiving the activate signal 5091 via the activate channel;

Step 606: the access control terminal 504 sends the rolling code key 5099 to the remote controller 502 via a first control channel (a second channel);

Step 608: the remote controller 502 inputs the rolling code key 5099 in the rolling code generator 5026 so as to generate the rolling code 5094 by the rolling code generator 5026;

Step 610: the remote controller 502 sends the control signal 5092 including the rolling code 5094 to the access control terminal 504 via a second control channel (a third channel) by using the telecommunication technology;

Step 612: the access control terminal 504 receives the control signal 5092 via the second control channel by using the telecommunication technology;

Step 614: the authorization process verifies if the control signal 5092 and the rolling code 5094 are consistent with a predetermined rule? If yes, go to step 616; if no, go to step 618;

Step 616: the access control terminal 504 unlocks a switch and/or a lock when the control signal 5092 and the rolling code 5094 are verified by the authorization process to be consistent with a predetermined rule; end; and Step 618: the access control terminal 504 does not unlock the switch and/or the lock when the control signal 5092 and the rolling code 5094 are verified by the authorization process to be not consistent with the predetermined rule.

In the lock control method 500, the activate channel for sending the activate signal 5091, the first channel for sending the rolling code key 5099 and the second control channel for sending the control signal 5092 may differ from one another. In steps 606 and 608, the access control terminal 504 sends the rolling code key 5099 to the remote controller 502 for the rolling code generator 5026 to generate the rolling code 5094. According to an embodiment of the present application, the rolling code generator 5026 may include a mathematical function and/or a decode table used for generate the rolling code 5094 according to the rolling code key 5099. The rolling code 5094 is a non-fixed secret code used to increase the difficulty of cracking the lock system. The said rolling code key 5099 may be a seed parameter for generating the non-fixed secret code (i.e. the rolling code 5094).

Multiple algorithms or means may be used to generate the rolling code 5094 according to the rolling code key 5099. One of them is shown in the following table.

| Signal name | Content of signal | | | | |
|---|---|---|---|---|---|
| Rolling code key 5099 | 1 | | 3 | | 5 |
| A table included in the rolling code generator 5026 for generating the rolling code 5094 | | 2 | | 4 | |
| The rolling code 5094 generated by the rolling code generator 5026 according to the rolling code key 5099 | 1 | 2 | 3 | 4 | 5 |
| The predetermined rule used by the signal process unit 506 for verifying the rolling code 5094 | 1 | 2 | 3 | 4 | 5 |

According to this embodiment, the rolling code 5094 is generated by filling the rolling code key 5099 into blanks of a table used to generate the rolling code 5094. When the access control terminal 504 (e.g. a door terminal) sends the rolling code key 5099 (e.g. 1 3 5 shown in the above table), the authorization process has set a verification code (e.g. 1 2 3 4 5 shown in the above table) corresponding to the rolling code key 5099 as the predetermined rule for verifying the received control signal. Hence, when a thief just uses a frequency scanner to know the used channels without knowing the mechanism of generating the rolling code 5094 by using the rolling code key 5099 and the rolling code generator 5026, it is difficult to crack the lock system. The table shown above is merely an example for describing the generation and verification of the rolling code 5094 by using the rolling code key 5099, other algorisms and means (e.g. mathematical functions) may be used to generate the rolling code 5094 with the rolling code key 5099 according to another embodiment of the present application.

A Fourth Embodiment

Figure 7:
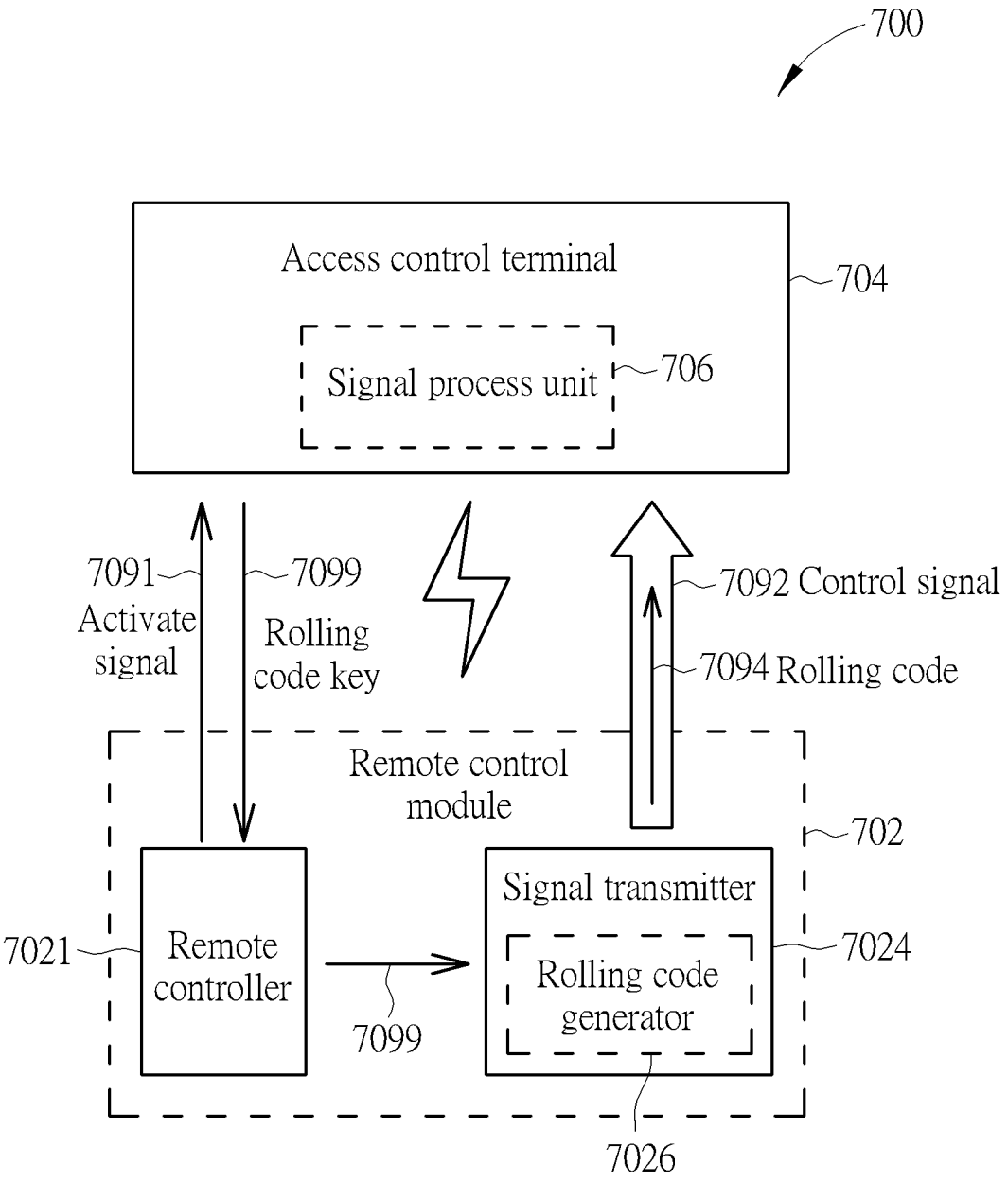
FIG. 7 illustrates a lock system according to a fourth embodiment of the present application.

FIG. 7 illustrates a lock system 700 according to a fourth embodiment of the present application. The lock system 700 includes a remote control module 702 and an access control terminal 704. The remote control module 702 is configured to transmit an activate signal 7091, transmit a control signal 7091 and receive a rolling code key 7099. The remote control module 702 includes a remote controller 7021 and a signal transmitter 7024. The remote controller 7021 is configured to transmit the activate signal 7091 and receive and transmit the rolling code key 7099. The signal transmitter 7024 includes a rolling code generator 7026. The rolling code generator 7026 is configured to generate a rolling code 7094 according to the rolling code key 7099. The access control terminal 704 (e.g. a door terminal) includes a signal process unit 706. The signal process unit 706 is configured to process the activate signal 7091 and a control signal 7092 received by the access control terminal and generate the rolling code key 7099. As shown in FIG. 7, the rolling code 7094 may be carried in the control signal 7092.

Figure 8:
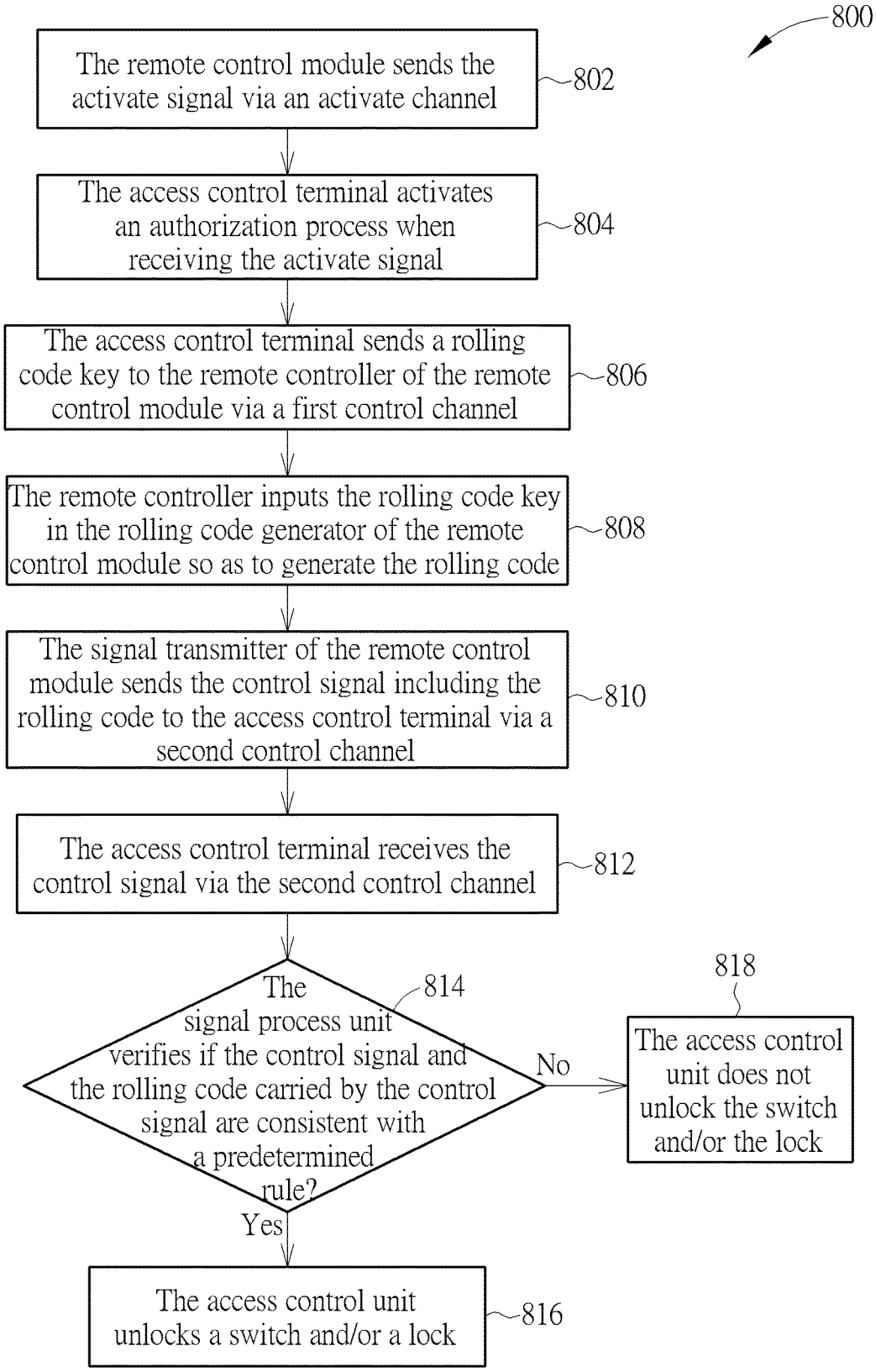
FIG. 8 illustrates a flow chart of a lock control method for controlling the lock system shown in FIG. 7.

FIG. 8 illustrates a flow chart of a lock control method 800 for controlling the lock system 700 shown in FIG. 7. The lock control method 800 includes the following steps.

Step 802: The remote control module 702 sends the activate signal 7091 via an activate channel (a first channel) by using a telecommunication technology;

Step 804: the access control terminal 704 activates an authorization process when receiving the activate signal 7091 via the activate channel;

Step 806: the access control terminal 704 sends a rolling code key 7099 to the remote controller 7021 of the remote control module 702 via a first control channel (a second channel) by using the telecommunication technology;

Step 808: the remote controller 7021 inputs the rolling code key 7099 in the rolling code generator 7026 of the remote control module 702 so as to generate the rolling code 7094 by the rolling code generator 7026;

Step 810: the signal transmitter 7024 of the remote control module 702 sends the control signal 7092 including the rolling code 7092 to the access control terminal 704 via a second control channel (a third channel) by using the telecommunication technology;

Step 812: the access control terminal 704 receives the control signal 7092 via the second control channel by using the telecommunication technology;

Step 814: the signal process unit 706 verifies if the control signal 7092 and the rolling code carried by the control signal 7092 are consistent with a predetermined rule? If yes, go to step 816; if no, go to step 818;

Step 816: the access control unit 804 unlocks a switch and/or a lock; end; and Step 818: the access control unit 804 does not unlock the switch and/or the lock.

According to the fourth embodiment of the present application shown in FIGS. 7 and 8, the remote controller shown in FIG. 1, 3 or 5 is replaced by the remote control module 702. The said remote controller 7021 may be a mobile phone; the signal transmitter 7024 may be an automotive electronic device or a security alarm device. Taking the access control terminal 704 which is a garage door for example, when a user arrives home, the user may operate the remote controller 7021 (e.g. a mobile phone) to send the activate signal 7091 to the access control terminal 704 via a telecommunication technology such as UHS radio, Wi-Fi, text message and/or instant message tool (e.g. Skype®, WhatsApp®). When receiving the activate signal, the access control terminal 704 may send back the rolling code key 7099 to the remote controller 7021 (e.g. a mobile phone). For example, the rolling code key 7099 may be a one-time password (OTP) sent by a text message. The remote controller 7021 may send the rolling code key 7099 to the signal transmitter 7024 (e.g. a signal transmitter installed in a car) via a rolling code key path (e.g. a Bluetooth channel, an NFC channel, or being entered manually by the user). The rolling code generator 7026 of the signal transmitter 7024 may generate the rolling code 7094 according the rolling code key 7099. The signal transmitter 7024 may send the control signal 7094 carrying the rolling code 7094 (e.g. by using carrier wave) to the access control terminal 704 for the authorization process activated by the access control terminal 704 to verify if the control signal 7092 and the rolling code 7094 are consistent with the predetermined rule.

According to an embodiment of the present application, when the remote controller 7021 is a smart phone, a user may download a mobile application (aka app) provided by a vendor of the lock system for using the lock system and the lock control method shown in FIGS. 7 and 8. Although the signal transmitter 7024 is included in the remote control module 702 along with the remote controller 7021, the signal transmitter 7024 may also installed with the access control terminal 704 (e.g. a door terminal). For example, when the access control terminal 704 is a door of a strongbox, the signal transmitter 7024 may be installed on the strongbox. When a user attempts to open the strongbox, the user may send the activate signal 7091 by the remote controller 7021 (e.g. a smart phone or a dedicated remote controller), the remote controller 7021 may then receive the rolling code key 7099 (e.g. a set of OTP expired in 30 seconds). The user may input the received rolling code key 7099 in the signal transmitter 7024, for example, by keying in the rolling code key 7099 via a number pad of the signal transmitter 7024 installed on the strongbox. The rolling code 7094 may be generated by the rolling code generator 7026 and sent out by being carried by the control signal 7092 to the access control terminal 704 from the signal transmitter 7024 for unlocking the access control terminal 704 (e.g. opening the strongbox) safely if the rolling code 7094 and the control signal 7092 are consistent with the predetermined rule. The way of generating the rolling code 7094 according to the rolling code key 7099 and verifying the rolling code 7094 and the control signal 7092 (e.g. by using a lookup table) may be similar to what described above according to the third embodiment, so it is not repeated again.

Figure 9:
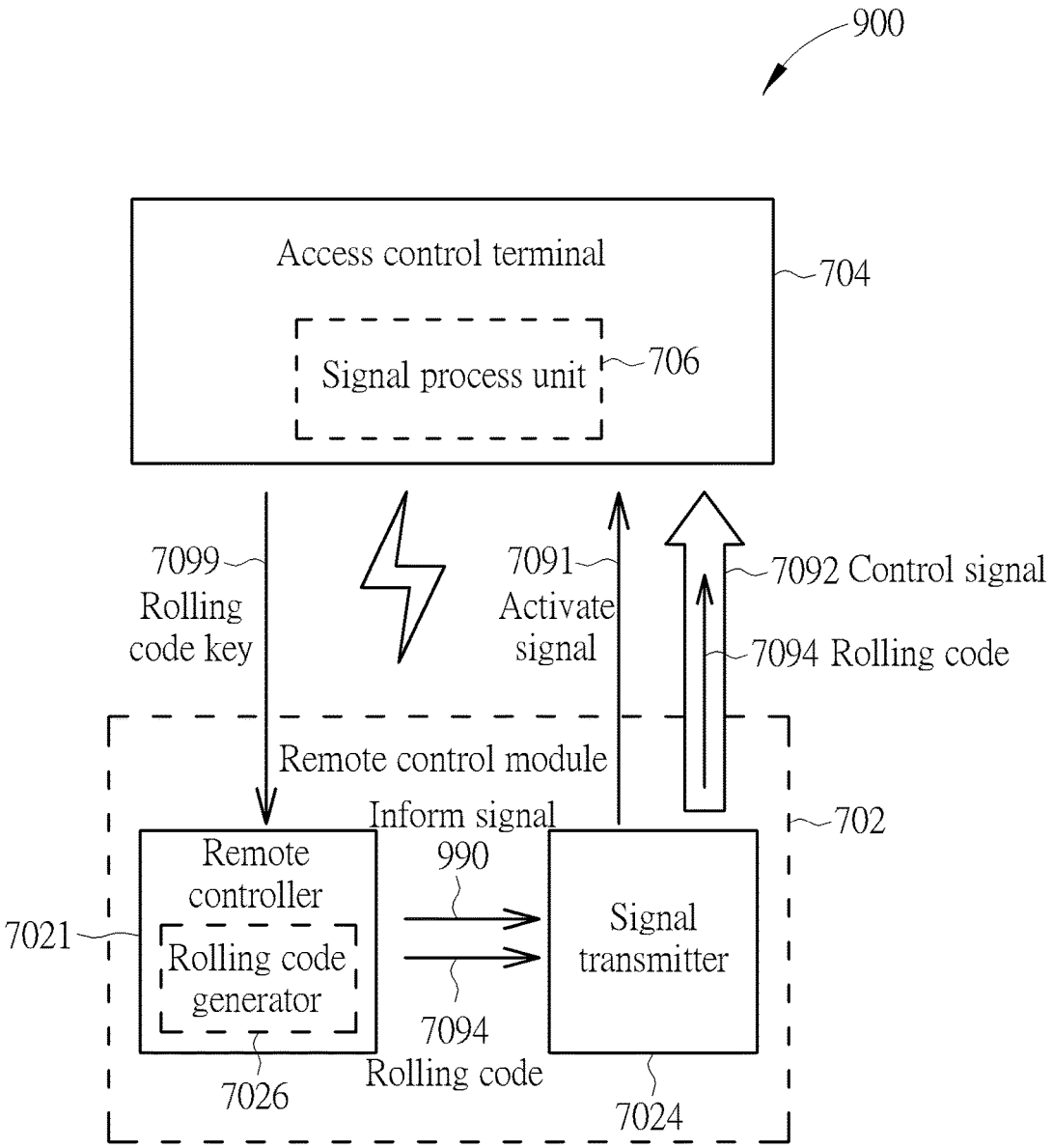
FIG. 9 illustrates another lock system according to the fourth embodiment of the present application.

FIG. 9 illustrates another lock system 900 according to the fourth embodiment of the present application. The lock system 900 is similar to the lock system 700, however, when a user of the lock system 900 attempts to unlock the access control terminal 704, the user may send an inform signal 990 to the signal transmitter 7024 via an third control channel (i.e. an inform channel) for the signal transmitter 7024 to send the activate signal 7091 to the access control terminal 704. When the remote controller 7099 receives the rolling code key 7099, the rolling code 7094 is generated by the rolling code generator 7026 included in the remote controller 7021 instead of being included in the signal transmitter 7024 as shown in FIG. 7. The remote controller 7021 (e.g. a smart phone) may thus generate the rolling code 7094 and send the rolling code 7094 to the signal transmitter 7024 (e.g. an automotive electronic device) for transmitting the control signal 7092 carrying the rolling code 7094 (e.g. by using carrier wave) to the access control terminal 704, and the authorization process may verify the control signal 7092 and the rolling code 7094 carried by the control signal 7092. The described rolling code generator may be integrated in the remote controller or the signal transmitter of the remote control module according to the fourth embodiment of the present application. The described activate signal may be sent to the access control terminal by the remote controller or the signal transmitter of the remote control module according to the fourth embodiment of the present application.

CONCLUSION

According to the described embodiments of the present application, the activate channel and a set of control channels different from the activate channel (i.e. multiple channels) may be adopted for better anti-theft effects. The said activate channel and the set of control channels may be fixed or vary by time. A non-fixed rolling code may be carried by the control signal for increasing the difficulty of cracking the lock system. According to the third and fourth embodiments, the rolling code may be generated further according to the rolling code key sent from the access control terminal to further increase the burden of cracking the lock system.

The said rolling code key may be generated by time of operating when the remote controller or the remote control module is well synchronized with the access control terminal. Taking the following tables for example, each rolling code is generated according to a corresponding rolling code key, and the rolling code varies with time of generation. For example, the rolling code generated at 9:36 A.M. is different from the rolling code generated at 8:14 P.M. That is to say, the rolling code is generated according to time and the rolling code key, so it is more difficult to crack the lock system.

| Operating time | 9:36 A.M. | | | | |
|---|---|---|---|---|---|
| Signal name | Content of signal | | | | |
| The rolling code key of the operating time | 3 | | 3 | | 3 |
| The table of the rolling code generator used for generating the rolling code of the operating time | | 2 | | 4 | |
| The rolling code generated according to the rolling code key | 3 | 2 | 3 | 4 | 3 |
| The predetermined rule of the operating time for the authorization process of the access control terminal to verify the rolling code | 3 | 2 | 3 | 4 | 3 |

| Operating time<br>Signal name | 8:14 PM<br>Content of signal | | | | |
|---|---|---|---|---|---|
| The rolling code key of the operating time | 5 | | 7 | | 7 |
| The table of the rolling code generator used for generating the rolling code of the operating time | | 3 | | 3 | |
| The rolling code generated according to the rolling code key | 5 | 3 | 7 | 3 | 7 |
| The predetermined rule of the operating time for the authorization process of the access control terminal to verify the rolling code | 5 | 3 | 7 | 3 | 7 |

According to the first to fourth embodiments described above, the access control terminal activating the authorization process when receiving the activate signal via the activate channel may be the access control terminal being turned on and activating the authorization process when receiving the activate signal. In other words, according to an embodiment of the present application, the electrical power supplying the signal process unit of the access control terminal may not be turned on before receiving the activate signal, and the lock system may not be unlocked even receiving correct control signals if not receiving the activate signal. Hence, the security is improved.

In FIG. 1, a key 1022 on the remote controller 102 is shown for a user to control (e.g. touch or press) to send signal, however, the key 1022 may be replaced with a graphic user interface (GUI), a voice control interface or other means. According to embodiments of the present application, the remote controller may be, inter alia, a button controller, a voice control device, a smart phone, a tablet computer, a laptop computer and/or a wearable device. The remote controller may include an identity recognition device such as a fingerprint recognition unit, a voiceprint recognition unit, a facial recognition device and/or an iris recognition device. The said telecommunication technology may be an infra-red technology, a radio frequency technology, a near field communication technology, a Wi-Fi technology, a Zigbee technology, a UHF radio technology, an internet network technology, an email technology, a browser interactive interface technology, an instant messaging (IM) technology and/or a mobile phone texting technology. The described multiple channels (also known as multi-channel) may be implemented not only by multiple channels with different frequencies respectively but also by channels of different communication technologies. For example, it may be regarded as using the said multiple channels when sending the activate signal via a UHF radio channel, receiving the rolling code key via a text message and transmitting the control signal via an NFC path. Furthermore, sending/receiving different signals with different IP addresses and/or different internet ports may be regarded as communicating with multiple channels. For example, a first port 127.0.0.1:8000 and a second port 127.0.0.1:8080 may be regarded as two different channels according to an embodiments of the present application.

In summary, the lock control method disclosed according to embodiments of the present application may increase the difficulty of cracking an anti-theft lock system by using multiple channels and the rolling codes, and the adopted multiple channels and rolling codes may be selected or generated by time so as to vary by time rather than staying fixed. The rolling code may be generated according to the rolling key for preventing a thief to duplicate a fake rolling code generator. Therefore, the lock system and the lock control method disclosed according to the present application can improve the security of the lock system greatly.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A lock control method, comprising:

sending, by a remote control module comprising a remote controller and a signal transmitter located separately at two different locations, an activate signal to an access control terminal via a first channel by using a telecommunication technology, the first channel being selected according to an operating time provided by a clock of the remote controller;

activating an authorization process by the access control terminal when receiving the activate signal via the first channel;

generating a rolling code key by the access control terminal, the rolling code key being dependent on an operating time provided by a clock of the access control terminal;

sending the rolling code key to the remote controller of the remote control module via a second channel by using the telecommunication technology, the second channel being selected according to an operating time provided by the clock of the access control terminal;

inputting the rolling code key in a rolling code generator of the remote controller so as to generate a rolling code by the rolling code generator according to the rolling code key and data obtained from the remote controller, the data being dependent on operating time provided by the clock of the remote controller;

sending the rolling code from the remote controller to the signal transmitter;

sending a control signal including the rolling code from the signal transmitter to the access control terminal via a third channel by using the telecommunication technology;

receiving the control signal from the signal transmitter by the access control terminal; and unlocking a switch and/or a lock by the access control terminal when the control signal and the rolling code are verified by the authorization process to be consistent with a predetermined rule;

wherein the clock of the remote controller is synchronized with the clock of the access control terminal.

2. The method of claim 1, wherein sending, by the remote control module comprising the remote controller and the signal transmitter located separately at the two different locations, the activate signal to the access control terminal via the first channel by using the telecommunication technology is:

sending, by the remote controller of the remote control module, the activate signal to the access control terminal via the first channel by using the telecommunication technology.

3. The method of claim 1, wherein sending, by the remote control module comprising the remote controller and the signal transmitter located separately at the two different locations, the activate signal to the access control terminal via the first channel by using the telecommunication technology is:

informing, by the remote controller of the remote control module, the signal transmitter of the remote control module via a fourth channel to send the activate signal via the first channel by using the telecommunication technology.

4. The method of claim 1, wherein inputting the rolling code key in the rolling code generator of the remote controller so as to generate the rolling code by the rolling code generator according to the rolling code key and the data obtained from the remote controller is:

inputting, by the remote controller, the rolling code key in the rolling code generator of the remote controller so as to generate the rolling code by the rolling code generator according to the rolling code key and the data obtained from the remote controller; and sending, by the remote controller, the rolling code to the signal transmitter via a fourth channel.

5. The method of claim 1, wherein activating the authorization process by the access control terminal when receiving the activate signal via the first channel is:

turning on a signal process unit and activating the authorization process of the signal process unit by the access control terminal when receiving the activate signal via the first channel.

* * * * *